US009468300B1

(12) United States Patent
Eatherly et al.

(10) Patent No.: US 9,468,300 B1
(45) Date of Patent: Oct. 18, 2016

(54) UNIVERSAL BACK SUPPORT FOR PIANO/ORGAN BENCHES

(71) Applicants: Franklin Michael Eatherly, Sarasota, FL (US); Joyce Simmons Pflum, Bradenton, FL (US)

(72) Inventors: Franklin Michael Eatherly, Sarasota, FL (US); Joyce Simmons Pflum, Bradenton, FL (US)

( * ) Notice: Subject to any disclaimer, the term of this patent is extended or adjusted under 35 U.S.C. 154(b) by 0 days.

(21) Appl. No.: 14/715,827

(22) Filed: May 19, 2015

Related U.S. Application Data

(60) Provisional application No. 62/012,687, filed on Jun. 16, 2014.

(51) Int. Cl.
*A47C 7/42* (2006.01)
*A47C 1/00* (2006.01)
*A47C 7/40* (2006.01)

(52) U.S. Cl.
CPC . *A47C 7/42* (2013.01); *A47C 1/00* (2013.01); *A47C 7/402* (2013.01)

(58) Field of Classification Search
USPC ..... 297/440.1, 440.2, 440.13, 440.15, 297/440.16
See application file for complete search history.

(56) References Cited

U.S. PATENT DOCUMENTS 1,860,381 A * 5/1932 Cable ..... A47C 4/02 297/440.2
2,244,474 A * 6/1941 Rainville ..... A47C 7/42 297/188.1
2,265,901 A * 12/1941 Greig ..... B60N 2/7064 297/452.11
3,093,410 A * 6/1963 Wilson ..... A47C 15/002 297/119
3,663,059 A * 5/1972 Omlie ..... A47C 4/028 297/440.2
3,722,952 A * 3/1973 Novitzky ..... A47C 4/08 108/132
3,751,107 A * 8/1973 Greitzer ..... A47C 4/02 297/440.2
3,891,267 A * 6/1975 Taylor ..... A47C 3/18 297/344.21
4,032,188 A * 6/1977 Jones ..... A47C 11/00 297/158.1
5,758,926 A * 6/1998 Wilkie ..... A61G 5/00 297/284.3
5,884,971 A * 3/1999 Davis ..... A47C 7/42 297/352
6,752,464 B1 * 6/2004 Tseng ..... A47C 4/02 297/411.35
6,752,465 B2 * 6/2004 Igarashi ..... B60N 2/242 296/63
7,252,339 B2 * 8/2007 Owens ..... A47C 4/02 297/440.1
7,575,283 B2 * 8/2009 Crowe ..... A47C 4/02 297/158.1
7,988,236 B2 * 8/2011 Brandtner ..... A47B 91/005 248/188.1
8,152,238 B2 * 4/2012 Timme ..... B08B 3/02 297/250.1
8,764,114 B1 * 7/2014 Frank ..... A47C 4/028 297/248
2006/0138821 A1 * 6/2006 Pan ..... A47C 7/02 297/230.13
2012/0256464 A1 * 10/2012 Chang ..... A47C 7/42 297/440.16
2014/0375103 A1 * 12/2014 Lejcher ..... A47C 4/028 297/440.1
2015/0159686 A1 * 6/2015 Davotian ..... A47C 19/005 5/282.1

* cited by examiner

*Primary Examiner* — Timothy J Brindley
(74) *Attorney, Agent, or Firm* — Dorothy S. Morse

(57) ABSTRACT

A universal upper back support primarily for piano and organ benches has been created, and is easily attached to any wooden bench used for instrument playing. The back support contains a cushion which is positioned at the correct angle by two vertical side pieces for engagement with the musician's upper back, and allows free movement of the arms, hips, and legs in any direction without any hindrances while the musician plays a selected instrument. The vertical side pieces may each optionally have a lower front indentation to allow easy opening of the hinged top seat of a music bench having an interior storage space, and the back support can be alternatively made with a manual adjustment mechanism that allows finger-activated vertical height adjustment of its cushion in selected pre-drilled holes. The back support can be provided with an installation template for ease of user installation.

8 Claims, 7 Drawing Sheets

UNIVERSAL BACK SUPPORT FOR PIANO/ORGAN BENCHES

CROSS REFERENCES TO RELATED APPLICATIONS

This application claims domestic benefit from U.S. provisional patent application 62/012,687, filed on Jun. 16, 2014, by one of the co-inventors herein, Franklin Eatherly. The application herein has subject matter substantially similar to that in the earlier filed provisional application, which has the title of Universal Back Support for Piano/Organ/Etc Benches. Since the 1-year term of U.S. provisional patent 62/012,687 has not yet expired, and the other conditions for domestic priority have been met, the applicant's claim for domestic priority is proper and should be approved.

BACKGROUND

1. Field of the Invention

The field of this invention is related to back supports, particularly to upper back supports for music benches, such as piano and organ benches.

2. Problems Solved and Description of Related Art

Musicians are often seated on a wooden bench while playing a piano or an organ. These wooden benches offer no back support and are often uncomfortable for the musician to sit on for long periods of time. While sitting, a musician's back can become tired and he/she will often slouch forward in an unprofessional looking position. Also, positioning of the musician on the bench could be incorrect without a proper form of upper back support. In addition, musician endurance levels can become lower without a proper form of back support, leaving the musician feeling tired and frustrated while playing.

All of these problems can be effectively reduced and/or eliminated by using the universal back support of the present invention for piano and organ benches. It can be used with padded or non-padded benches. Also, the unique, stylish, and innovative present invention back support utilizes a comfortable padded cushion in combination with a support frame, with the lower front ends of the frame's two vertical side pieces connected via bolts directly to the bottom wooden rail in the rear portion of a conventional wooden piano or organ bench. During use of the present invention back support, musicians can play their music for longer periods of time while maintaining a professional-looking, upright, and most importantly, comfortable, position during practice or performance.

No existing upper back support is known to provide all the features and advantages of this universal back support for music benches, including piano and organ benches.

BRIEF SUMMARY OF THE INVENTION

A universal back support has been created which is easily and securely attached to any wooden bench used for instrument playing by use of a template which shows the exact location for two holes to be drilled into the rear portion of the bench for receiving needed rail bolts. The present invention back support contains a cushion which is positioned correctly for the musician's back while allowing for free movement of the musician's arms, hips, and legs in any direction while playing the instrument. Top and middle rails enclose the cushion area while a bottom rail is present between the two vertical side pieces for extra support. There is also an indentation on the lower front surface of each vertical side piece which is positioned to allow for a hinged bench lid to be raised for interior access. The rail bolts at the bottom of each vertical side piece of the cushion's support frame attach to the bottom horizontal rail of the rear portion of the bench frame. Rabbeted areas on the interior surface of each vertical side rail, the bottom surface of the horizontal top rail, and the top surface of the horizontal middle rail, create a space within which the edges of the plywood and cushion unit become fixed into their desired position of use via fasteners and/or other fastening means.

PURPOSE AND BENEFITS

The present invention back support provides piano and organ players with a comfortable back rest while sitting on a conventional wooden bench with or without a cushioned seat.

It features a cushion positioned correctly for the back in order to accommodate long periods of playing music.

It also prevents a musician from becoming tired while playing music longer in the correct upright position that encourages good posture.

It further enables the free movement of the musician's arms, hips, and legs in any direction without any hindrances for playing, so that in piano and organ applications the musician's hands are free to move up or down the keyboard and feet can easily work all pedals.

In addition, it benefits any musician who is required to play for both short and long periods of time by keeping them comfortable and sitting in an upright position, and its preferred colonial or contemporary styling is suited for use in a wide variety of applications, and from concert halls to music practice rooms.

COMPONENT NUMBERS

Figure 1:
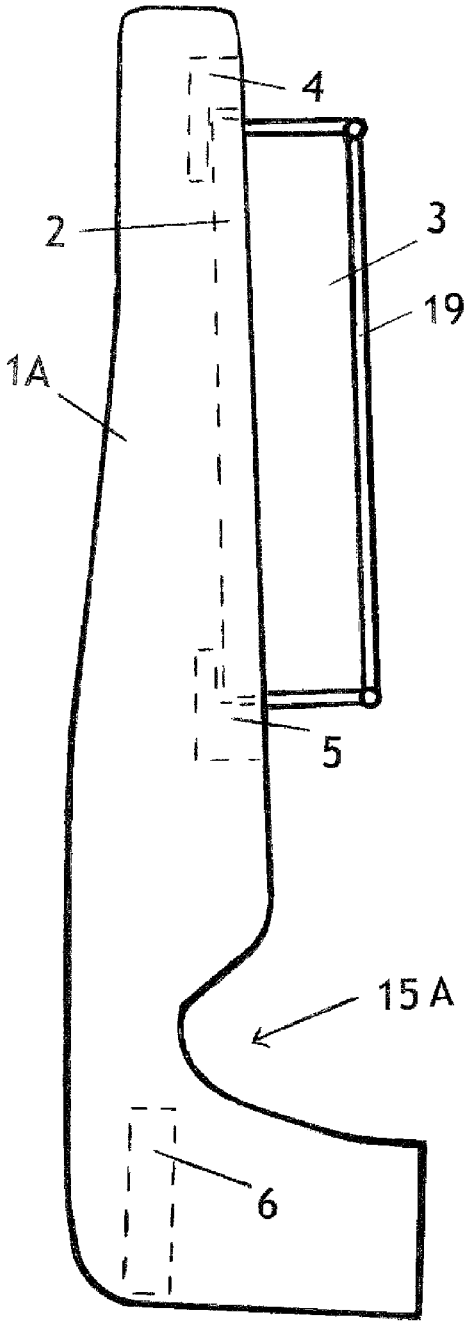
FIG. 1 is a side view of the most preferred non-adjustable universal back support of the present invention showing the upper portion of a specially designed left vertical side piece supporting a padded cushion. The right vertical side piece, which in FIG. 1 is hidden behind the left vertical side piece, is a mirror image of the left vertical side piece.

1A, 1B Vertical Side Pieces—left and right
2 Plywood
3 Cushion
4 Horizontal Top Rail
5 Horizontal Middle Rail
6 Horizontal Bottom Rail
7 Cover Trim Pieces
8 Wooden Guides
9 Adjustment Mechanism Unit
10 Wooden Glide
11 Center Spring
12A, 12B Manual Adjustment Rods—left and right
13 Spring Holder
14 Rail Bolts
15A, 15B Indentations on the lower front portion of Vertical Side Pieces 1A and 1B to allow opening of a bench lid for interior access
16A, 16B Manual Adjustment Pieces on each side of Adjustment Mechanism Unit 9 that are used to contain Center Spring 11 during its compression and extension and provide an exterior surface that can be engaged by a user's opposing finger and thumb to allow height adjustment of Cushion 3 by moving the distal ends of Manual Adjustment Rods 12A and 12B into different Holes 21 Pre-Drilled in the Vertical Side Pieces 1A and 1B
17 Caps placed on top and bottom of the Rabbeted Support Pieces 18 used in the adjustable embodiment of the present invention back support
18 Rabbeted Support Pieces attached to each of the opposed Vertical Side Pieces 1A and 1B for securing the Adjustment Mechanism Unit 9 into its desired position of use in the adjustable embodiment of the present invention back support
19 Beaded Edge of Cushion 3
20 Fasteners
21 Pre-Drilled Holes used in the Vertical Side Pieces 1A and 1B that receive Manual Adjustment Rods 12A and 12B in adjustable embodiments of the present invention for height adjustment of Cushion 3
22 Rabbeted Configurations in Vertical Side Pieces 1A and 1B, Top Rail 4, Middle Rail 5, Wooden Guides 8, and Rabbeted Support Pieces 18 made of wood (in other materials used to manufacture universal upper back support unit 1A-6, the number 22 represents a recess, groove, or cutout in an edge or surface needed to receive the edge of another component)

DETAILED DESCRIPTION OF THE INVENTION

The most preferred embodiments of the universal upper back support unit (1A, 1B, 2, 3, 4, 5, and 6) for piano and organ benches enables a musician to sit in a more comfortable position while on a wooden bench (not shown). It may be made in different sizes, and can be used by professional and non-professional musicians, adults and children alike. It also may be made primarily from wood (such as mahogany or lauan, but not limited thereto) that is preferably glued and screwed together to provide sturdy construction with a colonial or contemporary appearance, or it can be optionally made from other materials providing a different appearance, such as but not limited to, aluminum, fiberglass, or wrought iron. The universal upper back support unit assists in raising a musician's endurance level while playing music for longer periods of time. The invention comprises a cushion 3 typically attached to a piece of plywood 2, or other suitable material, which are fastened together (optionally with staples) and mounted to a frame comprising a horizontal top rail 4, a horizontal middle rail 5, a horizontal bottom rail 6, and two vertical side pieces 1A and 1B. The most preferred cushion 3 is high density and medium soft. Once it is assembled, this upper back support unit (1A-6) is then attached by rail bolts 14 (and also washers and nuts, not shown) to the bottom wooden rail (horizontal piece) on the rear surface of a conventional wooden music bench, with the washers and nuts remaining hidden within the interior of the bench. The two vertical side pieces 1A and 1B of the upper back support unit (1A-6) are arranged at a desired spaced-apart distance from one another and attached together using the three horizontal rails (4, 5, and 6), which are glued and preferably screwed into the vertical side pieces 1A and 1B. The cushion 3 and plywood 2 assembly is then screwed from the back to top rail 4 and middle rail 5 with fasteners 20 (shown in FIG. 6). Thereafter, the front lower end of each of the vertical side pieces 1A and 1B can be secured with a rail bolt 14 to connect the present invention back support unit (1A-6) to the bench in a desired position of use. FIGS. 1-7 and 9 show a non-adjustable embodiment of the present invention, while FIGS. 8A-8H show the adjustment mechanism unit 9 and how it is employed in adjustable embodiments of the present invention to allow several options for vertical height adjustment of cushion 3. Typical height adjustment of cushion 3 is between approximately two and three inches, but not limited thereto.

In preferred adjustable embodiments of the present invention back support unit (1A-6) for a music bench, it has been altered by adding a separate rabbeted support piece 18 that is glued and preferably screwed to the front surface of each of the vertical side pieces 1A and 1B to receive the plywood 2 with its attached cushion 3. The rear surface of the plywood 2 also receives adjustment mechanism unit 9, which comprises two wooden guides 8 and a wooden glide 10, in combination with a holder piece 13 for the center spring 11 and manual adjustment pieces 16A and 16B positioned on each side of the adjustment mechanism unit 9 that provide an exterior surface engaged by a user's opposing finger and thumb to allow height adjustment of cushion 3 by moving the distal ends of associated manual adjustment rods 12A and 12B into different holes 21 pre-drilled into the interior surfaces of the vertical side pieces 1A and 1B.

The universal back support for piano and organ benches according to preferred embodiments of the present invention can be constructed using wood, aluminum, iron, fiberglass, or other suitable materials. Exact size, measurement, construction, and design specifications may vary upon manufacturing and the intended application.

Figure 2:
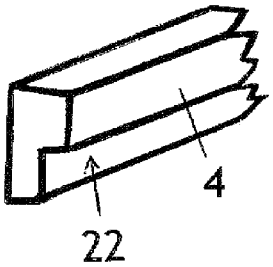
FIG. 2 is an enlarged perspective view of a portion of the horizontal top rail in the most preferred non-adjustable embodiment of present invention showing its rabbeted out lower configuration. Although an enlarged view of the horizontal middle rail is not shown in the accompanying illustrations, the horizontal middle rail is preferably identical in configuration to the horizontal top rail, but inverted in its orientation during use so that it has a rabbeted out upper configuration.
Figure 3:
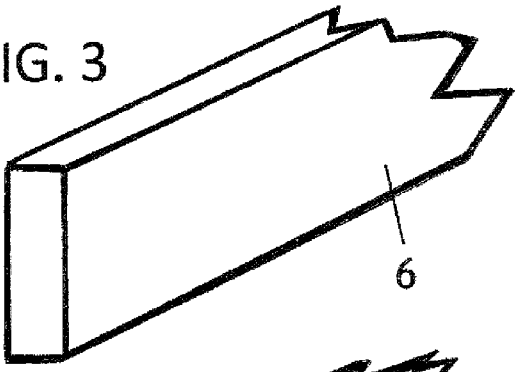
FIG. 3 is an enlarged perspective view of a portion of the bottom rail in the most preferred non-adjustable embodiment of present invention showing it having a generally rectangular shape, without any rabbeted out areas.
Figure 4:
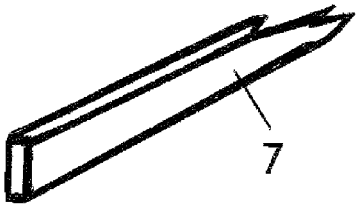
FIG. 4 is an enlarged perspective view of a portion of a piece of cover trim that is used in the most preferred non-adjustable embodiment of present invention on the back support's rear surface adjacent to portions of the vertical side pieces, the horizontal top rail, and the horizontal middle rail.
Figure 5:
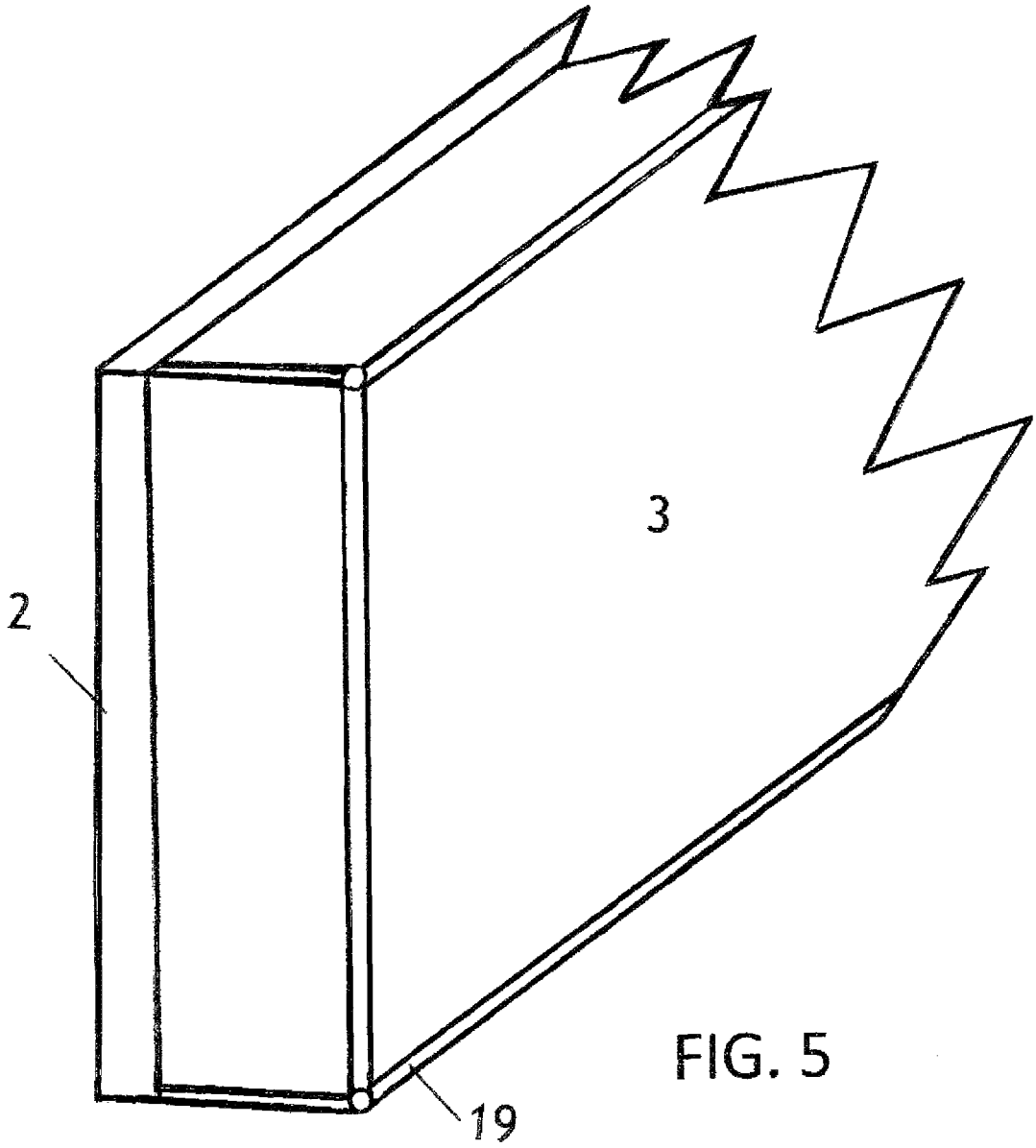
FIG. 5 is an enlarged perspective view of a portion of the plywood and attached cushion in the most preferred non-adjustable embodiment of present invention, which further shows the cushion having a beaded edge.
Figure 6:
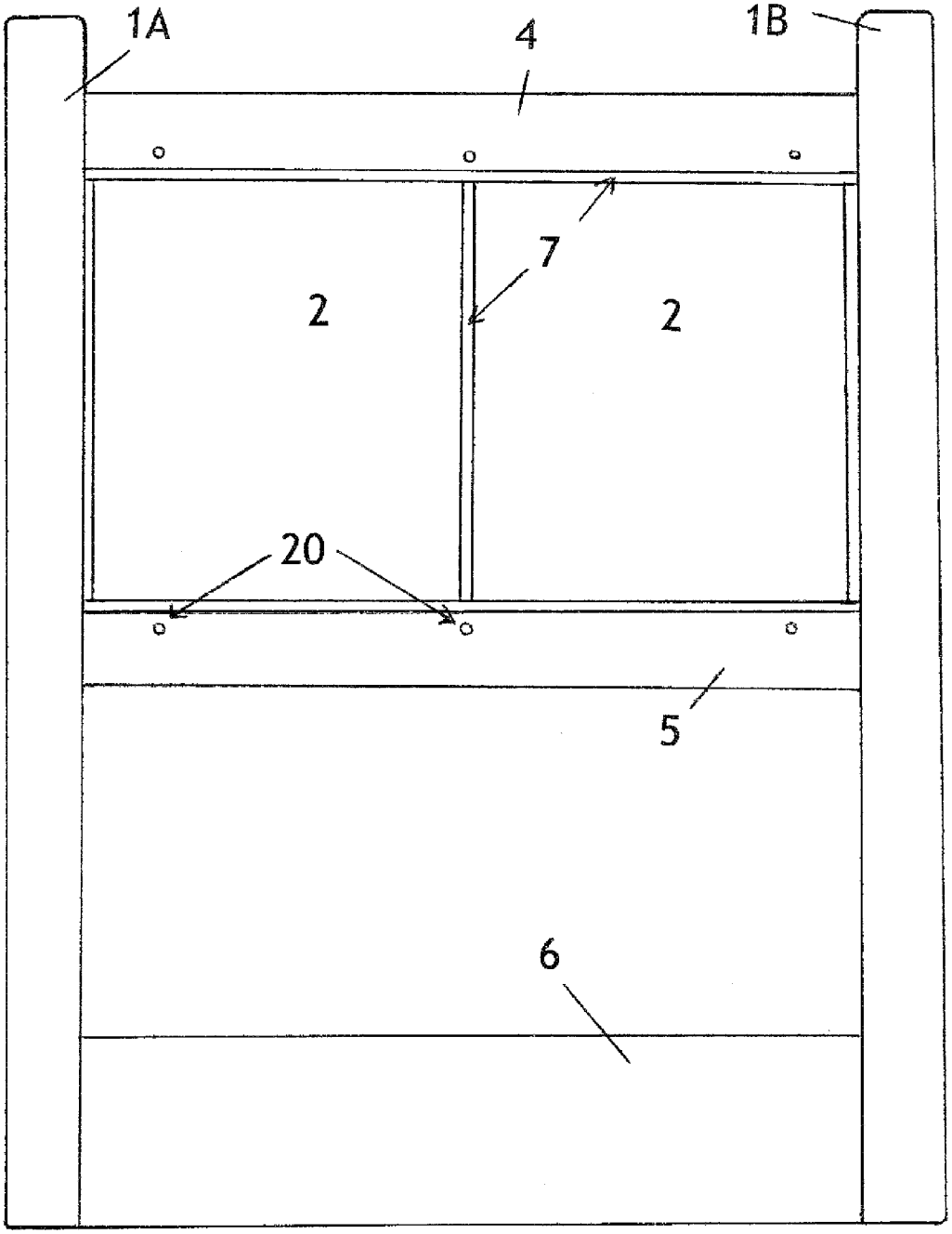
FIG. 6 is an enlarged rear view of the back support in the most preferred non-adjustable embodiment of present invention showing its vertical side pieces, the horizontal top rail, the horizontal middle rail, the horizontal bottom rail, the plywood used for cushion support, and several pieces of cover trim secured to the plywood.
Figure 7:
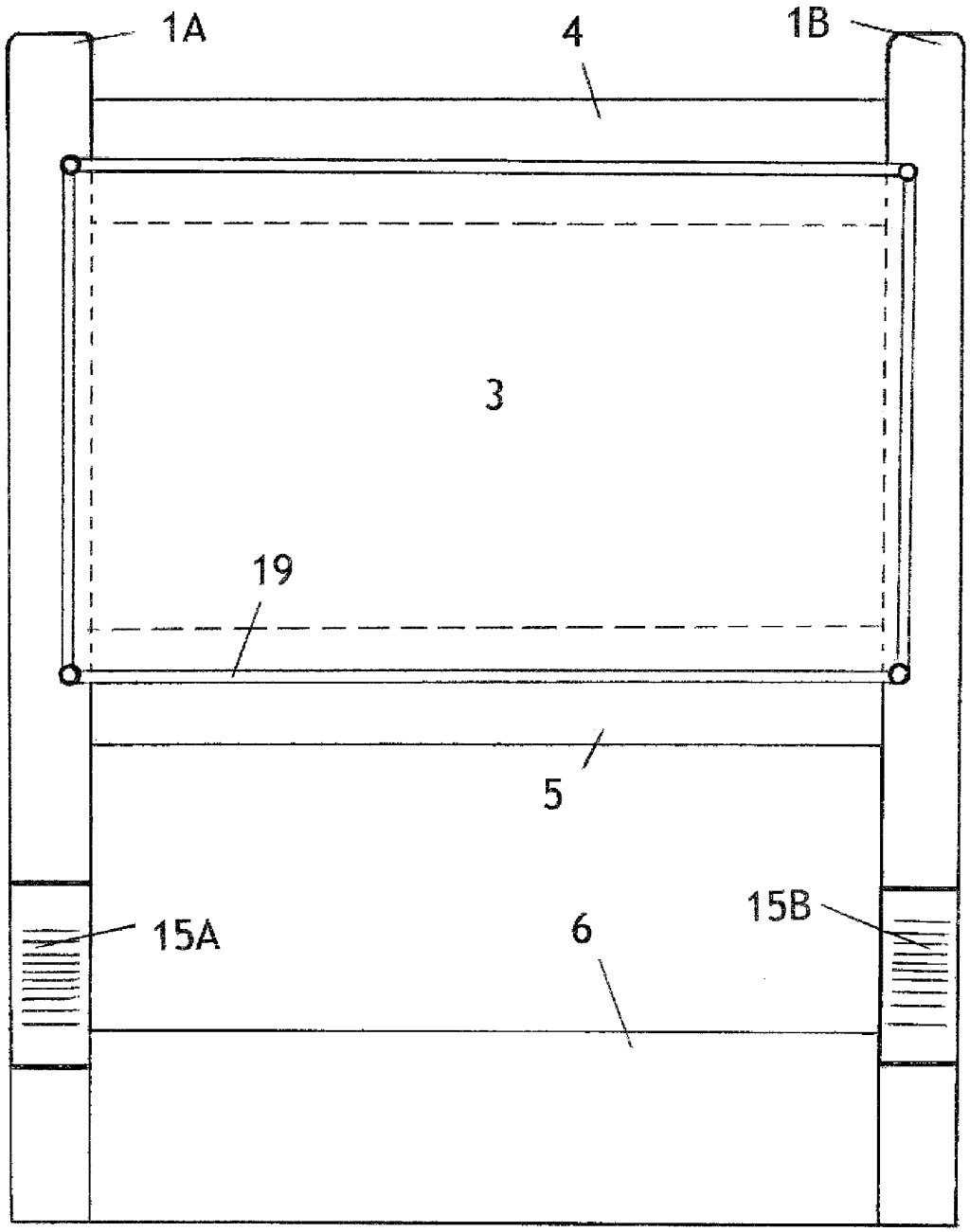
FIG. 7 is a front view of the back support in the most preferred non-adjustable embodiment of present invention showing its vertical side pieces, the horizontal top rail, the horizontal middle rail, the horizontal bottom rail, the cushion with its beaded edge, and the indentation on the front lower surface of each vertical side piece allowing for a bench lid to be raised for interior access.

FIG. 1 is a side view of the most preferred embodiment of the non-adjustable universal back support showing a specially designed left vertical side piece 1A with a rabbeted area (similar to the rabbeted configuration 22 shown in FIG. 8G) on the inside edge of the left vertical side piece 1A receiving the adjacent vertical edge of plywood 2 while it is supporting cushion 3. Two vertical side pieces 1A and 1B are used (see FIGS. 6, 7, and 9), with each vertical side piece 1A and 1B also containing rabbeted areas to accept portions of the three rails (top rail 4, middle rail 5, and bottom rail 6). In addition, the top rail 4 and middle rail 5 are rabbeted out to receive the opposed horizontal edges of plywood 2 while it is supporting cushion 3. The right vertical side piece 1B is not visible in FIG. 1, however in appearance it is the mirror image of the left vertical side piece 1A, as shown in FIGS. 6, 7, and 9. FIG. 1 also shows cushion 3 having a beaded edge 19 and the left vertical side piece 1A having a lower front indentation (marked by the number 15A) allowing the lid of an associated bench to be opened for interior access. FIG. 2 is an enlarged perspective view of the top rail 4 rabbeted out on its lower surface to receive the top horizontal edge of plywood 2 while it supports cushion 3. While an enlarged view of the middle rail 5 is not shown, it would appear as an inverted mirror image of top rail 4, with part of its upper surface rabbeted out to receive the bottom horizontal edge of plywood 2 while it supports cushion 3. FIG. 3 is a perspective view of the stabilizing bottom rail 6 that is connected between the lower portion of vertical side pieces 1A and 1B for extra support. FIG. 4 is a perspective view of one of the wooden cover trim pieces 7 used against the rear surface of plywood 2, as shown in FIG. 6. Cover trim pieces 7 are preferably positioned adjacent to the two vertical side pieces 1A and 1B, and the two rails 4 and 5. However, another cover trim piece 7 is preferably positioned vertically across the center of plywood 2 (as also shown in FIG. 6). Although the cross sectional configuration of the cover trim piece shown in FIG. 4 is preferred, it is not critical. Also, in wooden embodiments the present invention back support unit (1A-6) the cover trim pieces 7 are preferably glued to plywood 2. FIG. 5 is a perspective view of a portion of cushion 3 attached to plywood 2, and cushion 3 also having a beaded edge 19. Although the configurations and relative dimensions shown in FIGS. 1-5 for vertical side pieces 1A and 1B, plywood 2, cushion 3, rails 4, 5, and 6, cover trim pieces 7, indentations 15A and 15B, and beaded edges 19, are preferred in most embodiments of the present invention upper back support unit (1A-6), they are not critical, and other configurations and dimensions can be used as long as all present invention back support components can still fulfill their intended functions.

FIG. 6 shows the rear surface of the back support in the most preferred non-adjustable embodiment, with vertical side pieces 1A and 1B connected to horizontal railings 4, 5, and 6. The plywood 2 with its attached cushion 3 (which is not visible in FIG. 6) has been placed in the rabbeted area defined by rabbeted out portions of the vertical side pieces 1A and 1B, top rail 4, and middle rail 5. FIG. 6 also shows the cover trim pieces 7 applied to plywood 2 adjacent to the visible interior edges of vertical side pieces 1A and 1B, top rail 4, and middle rail 5, as well as vertically in the center of plywood 2. Although not limited thereto, cover trim pieces 7 are typically glued to plywood 2. FIG. 6 also shows preferred locations of fasteners 20 securing plywood 3 to top rail 4 and bottom rail 5. FIG. 7 is the front view of the back support in the most preferred non-adjustable embodiment of the present invention with the vertical side pieces 1A and 1B, and the top rail 4, the middle rail 5 and the bottom rail 6 all in an assembled configuration. Cushion 3 is visible in FIG. 7 (but not its attached plywood 2) and the cushion unit (2, 3) has been placed in the rabbeted area defined by the rabbeted bottom surface of top rail 4, the rabbeted top surface of middle rail 5, and the two opposed rabbeted interior surfaces of vertical side pieces 1A and 1B. Lower front indentations 15A and 15B are also respectively visible in FIG. 7 on vertical side pieces 1A and 1B which allow for the lid of an attached bench to be raised for interior access.

Figure 8A:
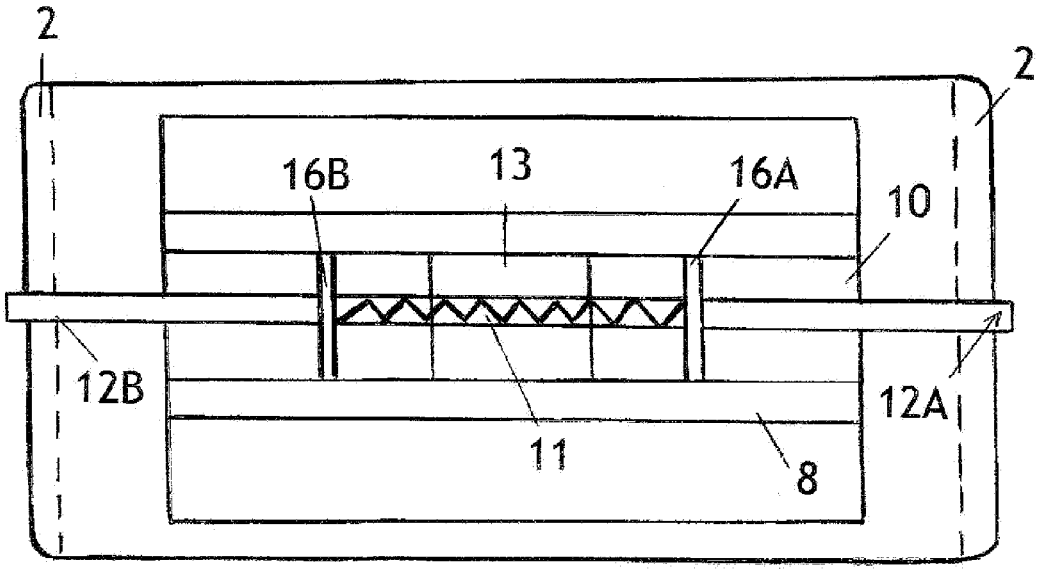
FIG. 8A is rear view of the plywood showing wooden guides used to receive the adjustment mechanism unit with a center spring and manual adjustment rods in the most preferred adjustable embodiment of the present invention.
Figure 8D:
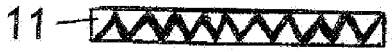
FIG. 8D is an enlarged side view of the center spring previously shown in FIG. 8A and usable as a part of the most preferred adjustable embodiment of the present invention.
Figure 8C:
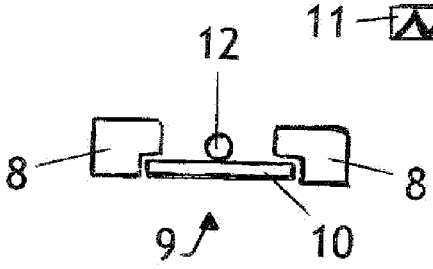
FIG. 8C is an enlarged end view of the adjustment mechanism unit previously shown in FIG. 8A and usable as a part of the most preferred adjustable embodiment of the present invention.
Figure 8B:
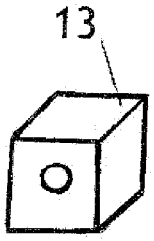
FIG. 8B is an enlarged perspective view of the spring holder previously shown in FIG. 8A and usable as a part of the most preferred adjustable embodiment of the present invention.
Figure 8E:
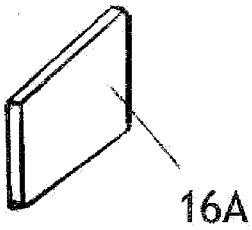
FIG. 8E is an enlarged perspective view of one of the manual adjustment pieces previously shown in FIG. 8A and used to contain the ends of the center spring during its compression and extension.

FIGS. 8A-8H show manual adjustment mechanism components that can be used in the alternative to create an adjustable embodiment of the present invention back support unit (1A-6) that allows height adjustment of its cushion 3, typically a distance of approximately two to three inches, although not limited thereto in all applications. FIG. 8A is rear view of the plywood 2 showing attached wooden guides 8 used as a part of the most preferred adjustable embodiment of the present invention to receive the adjustment mechanism unit 9, a spring holder 13, a center spring 11, a wooden glide 10, and two manual adjustment rods 12A and 12B. As shown in FIG. 8A, but not in FIG. 8C, spring holder 13 is located in the center of adjustment mechanism unit 9, and holds the spring 11 in its usable position. FIG. 8B is an enlarged perspective view of spring holder 13, while FIG. 8D provides an enlarged view of center spring 11. The numbers 16A and 16B in FIG. 8A represent the manual adjustment pieces used to contain the ends of the center spring 11 during its compression and extension while inserted through the central bore of spring holder 13. See FIG. 8E for an enlarged view of one of the substantially rectangular manual adjustment pieces 16A. Although not shown in a separate enlarged illustration, the second manual adjustment piece 16B is identical in structure to manual adjustment piece 16A. It is these manual adjustment pieces 16A and 16B that a user compresses and releases with an opposed finger and thumb to cause compression or expansion of center spring 11 to release the distal ends of manual adjustment rods 12A and 12B from pre-drilled holes 21 and allow height adjustment of cushion 3 before the user's finger and thumb grip on manual adjustment pieces 16A and 16B is released, allowing the distal ends of manual adjustment rods 12A and 12B to become inserted in newly selected pre-drilled holes 21 in the interior surfaces of the left and right vertical side pieces 1A and 1B. FIG. 8C shows an enlarged end view of the adjustment mechanism unit 9 components previously shown in FIG. 8A, including wooden glide 10, manual adjustment rods 12A and 12B, and the rabbeted wooden guides 8 used to hold wooden glide 10 adjacent to the rear surface of plywood 2. Although not shown in the accompanying illustrations, in adjustable embodiments of the present invention the manual adjustment mechanism 9 components are typically hidden from view behind an unadorned and easily removable cover member.

Figure 8F:
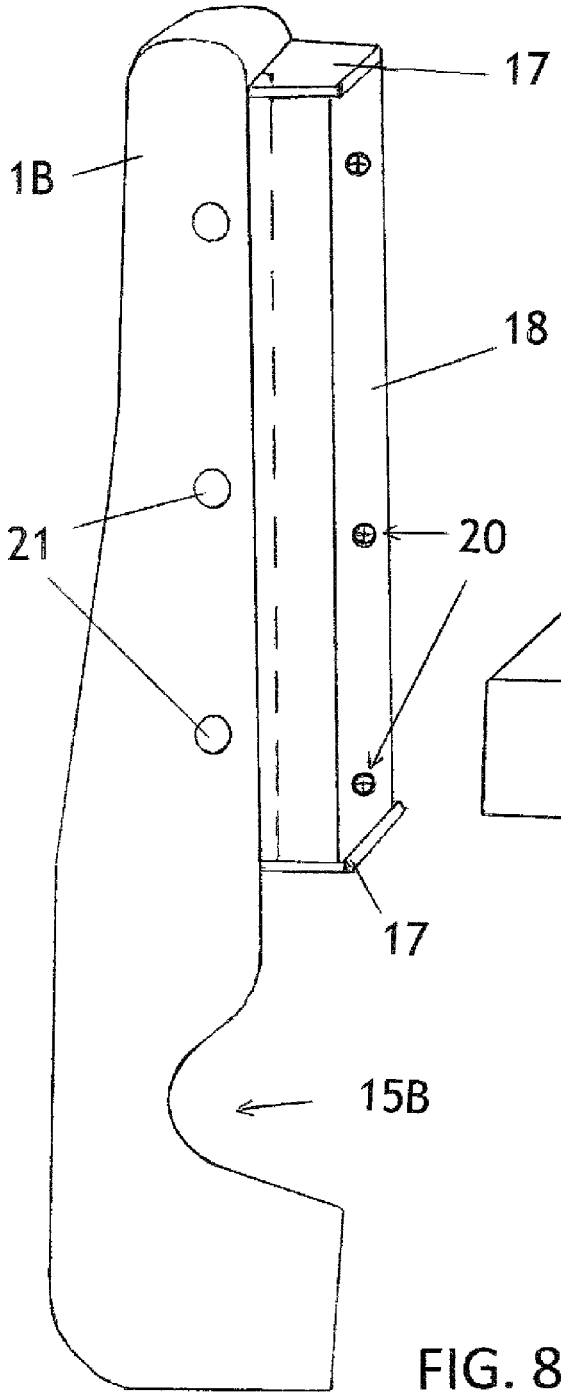
FIG. 8F is a perspective view of the separate rabbeted support piece attached to the front surface of the right vertical side piece in the most preferred adjustable embodiment of the present invention back support, which is employed to mount the adjustment mechanism unit in its desired position of use. The left vertical side piece and rabbeted support piece combination is a mirror image of the structure shown in FIG. 8F.
Figure 8G:
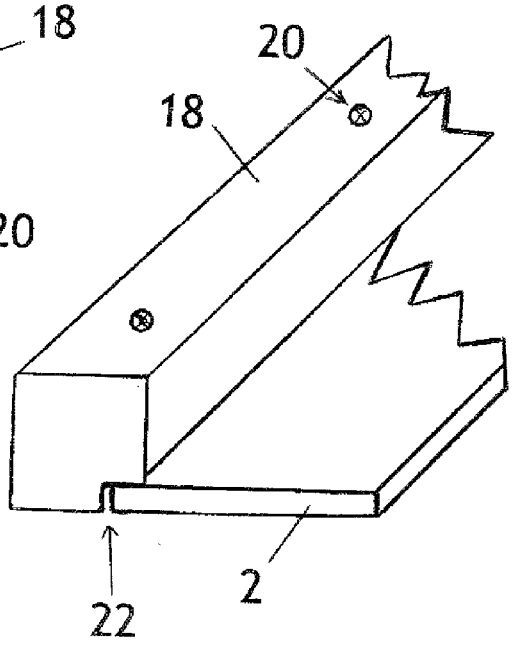
FIG. 8G is an enlarged perspective view from one end of a portion of the piece of plywood secured in its desired position of used within the rabbeted out areas created between the two opposed support pieces in the most preferred adjustable embodiment of the present invention back support.
Figure 8H:
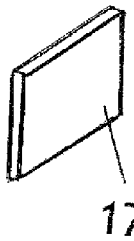
FIG. 8H is an enlarged perspective view of one of the caps shown in FIG. 8F that is usable as a part of the most preferred adjustable embodiment of present invention.
Figure 9:
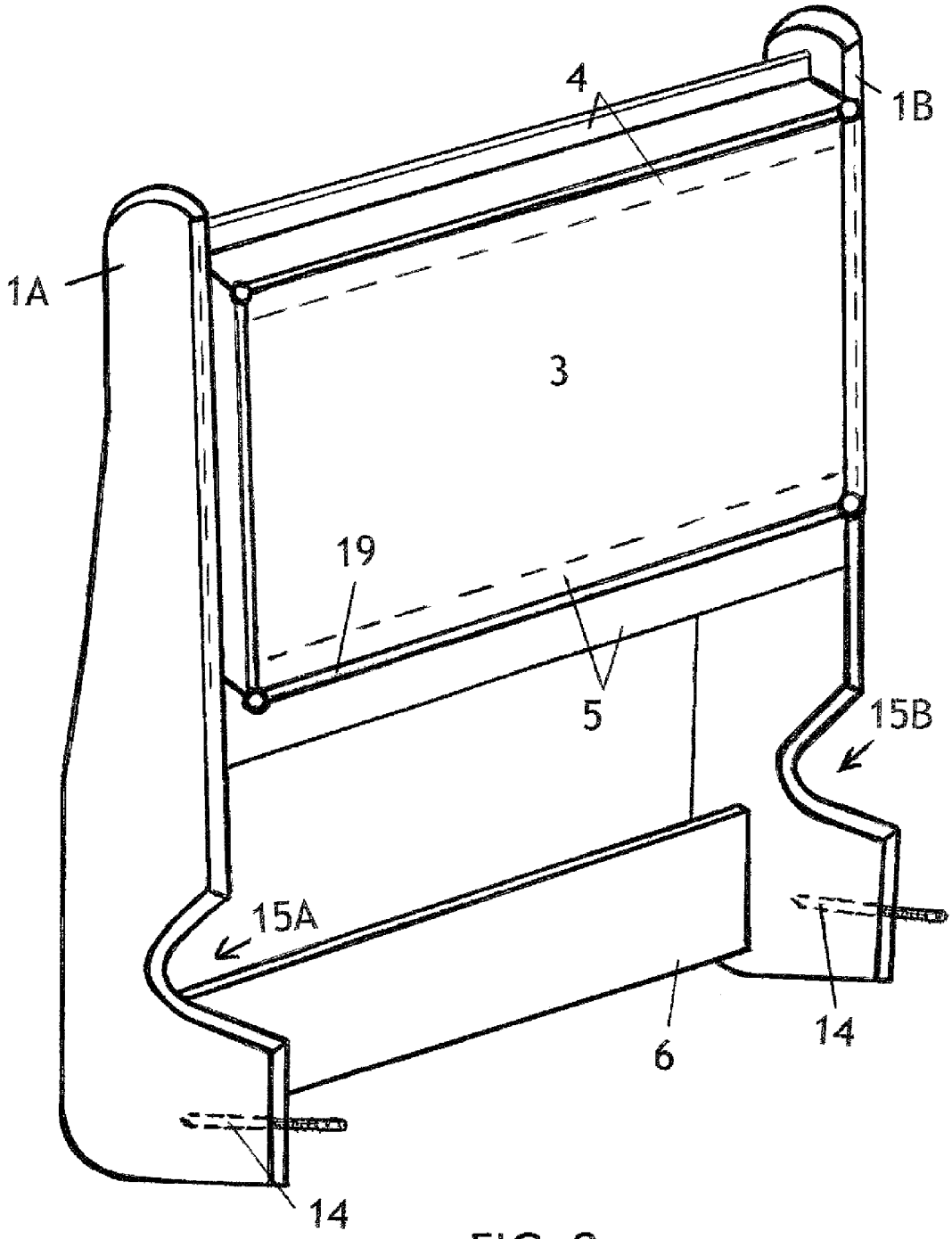
FIG. 9 is a perspective view of the most preferred non-adjustable embodiment of the present invention upper back support assembly previously shown in whole or in part in FIGS. 1-7, with FIG. 9 showing preferred positioning for a rail bolt in the lower front end of each of the opposed vertical side pieces.

FIGS. 8F-H show the preferred configuration of a rabbeted support piece 18, one of which is attached to the front surface of each of the opposed vertical side pieces 1A and 1B and used for securing the adjustment mechanism unit 9 into its desired position of use in adjustable embodiments of the present invention back support unit (1A-6). FIG. 8F is a perspective view of the separate rabbeted support piece 18 attached to the front of right vertical side piece 1B with several fasteners 20. FIG. 8F also shows vertical side piece 1B having a front indentation 15B below rabbeted support piece 18 and similar caps 17 attached to the top and bottom ends of rabbeted support piece 18. FIG. 8G is an enlarged perspective view from one end of a portion of the vertical edge of plywood 2 secured into its desired position of use within the rabbeted out area defined between the two opposed rabbeted configurations 22 of left and right support pieces 18. FIG. 8H is an enlarged perspective view of one of the caps 17 shown in FIG. 8F attached to the top and bottom ends of rabbeted support piece 18. The rabbeted support pieces 18 are glued and fastened (preferably with screws, but not limited thereto) to the front surface of the vertical side pieces 1A and 1B to define a rabbeted out area where the vertical edges of plywood 2 can fit while supporting cushion 3 on its front surface and the adjustment mechanism unit 9 on its opposed back surface. FIG. 8F shows the interior surface of vertical side piece 1B having three pre-drilled holes 21, each hole 21 sized to receive the distal end of one manual adjustment rod 12B. Also, although the use of three pre-drilled holes 21 is preferred, the number of pre-drilled holes 21 used as a part of the present invention adjustable upper back support unit (1A-6) may be higher or lower than the number shown in FIG. 8F. Furthermore, although not shown in the accompanying illustrations, as long as manual adjustment rods 12A and 12B are aligned, vertical side piece 1A will have the same number and positioning of pre-drilled holes 21 shown in FIG. 8F for vertical side piece 1B. Although the configurations and relative dimensions of present invention components shown in FIGS. 8A-8H are preferred in most embodiments of the present invention upper back support unit, they are not critical, and other configurations and dimensions can be used as long as all present invention back support components can still fulfill their intended functions.

FIG. 9 is a perspective view of the non-adjustable present invention back support previously shown in FIGS. 1-7 in an assembled condition. The vertical side pieces 1A and 1B, the cushion 3, the rails 4, 5, 6, and the rail bolts 14 used to attach the assembled back support to a bench, are depicted. As is more clearly shown in FIG. 1, the front edges of vertical side pieces 1A and 1B adjacent to their respective middle portions and positioned above indentations 15A and 15B are each rearwardly inclined relative to the substantially vertically extending front edges of vertical side pieces 1A and 1B adjacent to their respective lower portions positioned below indentation 15A (and below the indentation 15B, behind 15A, that remains hidden in FIG. 1), allowing the front surface of attached cushion 3 to have fixed rearward-inclined positioning relative to a piano bench connected to both of the lower portions of vertical side pieces 1A and 1B via the substantially vertically extending front edges of the lower portions. FIG. 9 also shows indentations 15A and 15B respectively on the lower front surfaces of vertical side pieces 1A and 1B, below cushion 3, which allow the lid of an associated bench to be raised for interior access, when present. In FIGS. 1, 8F, and 9, the front-to-back width dimension of the lower portions of the vertical side pieces are shown to be greater than those of said middle portions, and lid-accommodating indentations 15A and 15B are shown to be rearwardly narrowing and asymmetrical. In addition, FIG. 9 shows the preferred beaded edge 19 of cushion 3. The rail bolts 14 shown in FIG. 9 are attached to the rear surface of the bench frame with washers and nuts (not shown), which remain hidden within the bench interior. The broken lines around the cushion represent the preferred rabbeted areas on the vertical side pieces 1A and 1B, top rail 4, and middle rail 5, defining a rabbeted space or channel for insertion of the vertical edges of plywood 2 while attached to cushion 3.

While the written description of the invention herein is intended to enable one of ordinary skill to make and use its best mode, it should also be appreciated that the invention disclosure only provides examples of specific embodiments and methods, and many variations, combinations, and equivalents also exist which are not specifically mentioned. The present invention should therefore not be considered as limited to the above-described embodiments, methods, and examples, but instead encompassing all embodiments and methods within the scope and spirit of the invention as disclosed and defined in the accompanying claims.

We claim:

1. A back support for a bench having a hinged lid, said back support comprising:

a left vertical side piece including an interior surface having a front edge with a recess fully along said front edge, said left vertical side piece also having a top portion, a middle portion, and a lower portion, said lower portion having a greater front-to-back width dimension than said middle portion, said left vertical side piece further having a front surface with an indentation positioned between said middle and lower portions and allowing a hinged lid to open for interior bench access, said front surface of said left vertical side piece associated with said lower portion substantially vertically extending, said front surface of said left vertical side piece associated with said middle portion rearwardly inclined relative to said front surface of said lower portion, with connection of said indentation between said middle and lower portions each having different width dimensions and front surface inclination causing indentation to have a rearwardly narrowing and asymmetrical configuration:

a right vertical side piece including an interior surface having a front edge with a recess fully along said front edge, said right vertical side piece also having a top portion, a middle portion, and a lower portion, said lower portion having a greater front-to-back width dimension than said middle portion, said right vertical side piece further having a front surface with an indentation positioned between said middle and lower portions and allowing a hinged lid to open for interior bench access, said front surface of said right vertical side piece associated with said lower portion substantially vertically extending, said front surface of said right vertical side piece associated with said middle portion rearwardly inclined relative to said front surface of said lower portion, with connection of said indentation between said middle and lower portions each having different width dimensions and front surface inclination causing said indentation to have a rearwardly narrowing and asymmetrical configuration;

a top rail connected between said top portion of said left vertical side piece and said top portion of said right vertical side piece, said top rail having a recessed bottom edge;

a middle rail connected between said middle portion of said left vertical side piece and said middle portion of said right vertical side piece, said middle rail having a recessed top edge, wherein said opposed front edge recesses in said interior surfaces of said left and right vertical side pieces in combination with said opposed recessed edges in said top rail and said middle rail define a channel;

a stabilizing bottom rail connected between said lower portion of said left vertical side piece and said lower portion of said right vertical side piece, and also positioned rearward to said indentations;

a cushion attached to a cushion support member having a perimeter dimension at least as large as that of said cushion, said cushion support member received in said channel; and at least one fastener associated with said front surface of each of said lower portions of said vertical side pieces, wherein when said front edge recesses in said interior surfaces of said left and right vertical side pieces are opposed, and said recessed bottom edge in said top rail and said recessed top edge in said middle rail are also opposed, said perimeter of said cushion support member is secured within said channel defined collectively by all said opposed recessed edges allowing said cushion attached to said cushion support member to provide upper back support at a rearwardly inclined angle for a person seated on a music bench secured to said substantially vertically extending surfaces of said lower portions of said vertical side pieces via said fasteners.

2. The back support of claim 1 further comprising at least one piece of cover trim secured to said cushion support member.

3. The back support of claim 1 wherein said cushion contains high density and medium soft cushioning material.

4. The back support of claim 1 wherein said cushion support member is made from plywood.

5. The back support of claim 1 wherein said cushion has a beaded edge.

6. The back support of claim 1 wherein said left vertical side piece and said right vertical side piece are mirror images of one another.

7. A back support for a music bench having a hinged lid, said back support comprising:

a left vertical side piece including an interior surface having a front edge with a rabbeted area fully along said front edge, said left vertical side piece also having a top portion, a middle portion, and a lower portion, said lower portion having a greater front-to-back width dimension than said middle portion, said left vertical side piece further having a front surface with an indentation positioned between said middle and lower portions and allowing a hinged lid to open for interior bench access, said front surface of said left vertical side piece associated with said lower portion substantially vertically extending, said front surface of said left vertical side piece associated with said middle portion rearwardly inclined relative to said front surface of said lower portion, with connection of said indentation between said middle and lower portions each having different width dimensions and front surface inclination causing indentation to have a rearwardly narrowing and asymmetrical configuration:

a right vertical side piece including an interior surface having a front edge with a rabbeted area fully along said front edge, said right vertical side piece also having a top portion, a middle portion, and a lower portion, said lower portion having a greater front-to-back width dimension than said middle portion, said right vertical side piece further having a front surface with an indentation positioned between said middle and lower portions and allowing a hinged lid to open for interior bench access, said front surface of said right vertical side piece associated with said lower portion substantially vertically extending, said front surface of said right vertical side piece associated with said middle portion rearwardlv inclined relative to said front surface of said lower portion, with connection of said indentation between said middle and lower portions each having different width dimensions and front edge inclination causing said indentation to have a rearwardly narrowing and asymmetrical configuration;

a top rail connected between said top portion of said left vertical side piece and said top portions of said right vertical side piece, said top rail having a rabbeted out bottom edge;

a middle rail connected between said middle portion of said left vertical side piece and said middle portion of said right vertical side piece, said middle rail having a rabbeted out top edge wherein said opposed front edge rabbeted areas in said interior surfaces of said left and right vertical side pieces in combination with said opposed rabbeted out edges in said top rail and said middle rail define a rabbeted spaces;

a stabilizing bottom rail connected between said lower portion of said left vertical side piece and said lower portion of said right vertical side piece, and also positioned rearward to said indentations;

a cushion attached to a cushion support member having a perimeter dimension at least as large as that of said cushion said cushion support member received in said rabbeted space; and at least one fastener associated with said front surface of each of said lower portions of said vertical side pieces, wherein when said rabbeted areas in said interior surfaces of said left and right vertical side pieces are opposed, and said rabbeted out bottom edge in said top rail and said rabbeted out top edge in said middle rail are also opposed, said perimeter of said cushion support member is secured within said rabbeted space defined collectively by all said opposed rabbeted areas and rabbeted out areas, allowing said cushion attached to said cushion support member to provide upper back support at a rearwardly inclined angle for a person seated on a music bench secured to said substantially vertically extending surfaces of said lower portions of said vertical side pieces via said fasteners.

8. The back support of claim 7 wherein said cushion contains high density and medium soft cushioning material.

* * * * *